US011874096B2

(12) United States Patent
Pappas

(10) Patent No.: US 11,874,096 B2
(45) **Date of Patent: *Jan. 16, 2024**

(54) FURNITURE INLAY PERSONAL PROTECTION SHIELD

(71) Applicant: Cary C. Pappas, Collierville, TN (US)

(72) Inventor: Cary C. Pappas, Collierville, TN (US)

( * ) Notice: Subject to any disclaimer, the term of this patent is extended or adjusted under 35 U.S.C. 154(b) by 44 days.

This patent is subject to a terminal disclaimer.

(21) Appl. No.: 17/741,534

(22) Filed: May 11, 2022

(65) Prior Publication Data

US 2022/0364832 A1 Nov. 17, 2022

Related U.S. Application Data

(63) Continuation-in-part of application No. 17/319,096, filed on May 13, 2021, now Pat. No. 11,359,890.

(51) Int. Cl.

| | |
|---|---|
| ***F41H 5/08*** | (2006.01) |
| ***F41H 5/013*** | (2006.01) |
| *A47B 41/02* | (2006.01) |

(52) U.S. Cl.

CPC ..... *F41H 5/08* (2013.01); *F41H 5/013* (2013.01); *A47B 41/02* (2013.01); *A47B 2220/0091* (2013.01)

(58) Field of Classification Search

CPC ..... F41H 5/08; F41H 5/06; A47B 13/088

See application file for complete search history.

(56) References Cited

U.S. PATENT DOCUMENTS

| | | | | |
|---|---|---|---|---|
| 6,170,379 | B1 | 1/2001 | Taylor | |
| 10,634,463 | B1 | 4/2020 | DeAngeles | |
| 2007/0125224 | A1 | 6/2007 | Thomas | |
| 2017/0167829 | A1 | 6/2017 | Thomas | |
| 2020/0261022 | A1* | 8/2020 | Gruentzig | A61B 5/6804 |
| 2020/0378728 | A1* | 12/2020 | DeCamp | B44F 1/00 |

* cited by examiner

*Primary Examiner* — J. Woodrow Eldred

(74) *Attorney, Agent, or Firm* — H. Brock Kolls

(57) ABSTRACT

The present invention relates to a furniture inlay personal protection shield that is removable from furniture to provide personal protection, in an emergency, from bodily harm threats. The furniture inlay personal protection shield comprises an exterior surface inlay that is sized and fabricated to fit into a predefined opening in the furniture surface, a bullet-resistant inner liner affixed to the interior surface of the exterior surface inlay, a one-way viewable bullet-resistant material is integrated into and away from the perimeter of the exterior surface inlay, and at least one handle proximate the bullet-resistant inner liner where a user can, by way of the handle, securely position the bullet-resistant inner liner between the user and the bodily harm threat. Exemplary embodiments include an ammunition impact sensor for detecting bullet impacts on furniture inlay personal protection shield.

18 Claims, 10 Drawing Sheets

FURNITURE INLAY PERSONAL PROTECTION SHIELD

CROSS-REFERENCE TO RELATED APPLICATIONS

This application contains subject matter which is related to the subject matter of the following co-pending application. The below-listed application is hereby incorporated herein by reference in its entirety:

This is a U.S. non-provisional application that is a continuation in part of a U.S. non-provisional application Ser. No. 17/319,096, inventor Cary C. Pappas, entitled "FURNITURE INLAY PERSONAL PROTECTION SHIELD", filed May 13, 2021.

TECHNICAL FIELD OF THE INVENTION

This invention relates to a furniture inlay personal protection shield that is removable from furniture to provide personal protection, in an emergency, from bodily harm threats.

BACKGROUND OF THE INVENTION

Before our invention, we have all seen the unconscionable acts of violence often characterized or referred to as active shooter situations, workplace violence events, or called other similar names. Brief events in time that dramatically impact the lives of those involved forever. In many of these events, there are lethal weapons used on groups of innocent unarmed people with little opportunity for them to protect themselves. Run and hide is often the strategy taught in active shooter training survival workshops. While turning schools and offices into fortresses and secured bunkers are not always practical options, there is a long-felt need that gives rise to the present invention for furniture in schools, offices, warehouses, truck vehicles, and other places that can be transformed into a shield and used by people to protect themselves and others from bodily harm threats.

SUMMARY OF THE INVENTION

The shortcomings of the prior art are overcome and additional advantages are provided through the provision of a furniture inlay personal protection shield is removable from furniture to provide personal protection, in an emergency, from bodily harm threats, the furniture inlay personal protection shield comprises an exterior surface inlay that is sized and fabricated to fit into a predefined opening in furniture surface. A bullet-resistant inner liner is affixed to the interior surface of the exterior surface inlay. A one-way viewable bullet-resistant material is integrated into and away from the perimeter of the exterior surface inlay, the one-way viewable bullet-resistant material is see-through in only one direction providing a viewport therethrough such that a user positioned behind the furniture inlay personal protection shield can see bodily harm threat but bodily harm threat cannot see the user. And, at least one handle is affixed proximate to the bullet-resistant inner liner where a user can, by way of the handle, securely position the bullet-resistant inner liner between the user and bodily harm threat.

Additional shortcomings of the prior art are overcome and additional advantages are provided through the provision of a method of using a furniture inlay personal protection shield that is removable from furniture to provide personal protection, in an emergency, from bodily harm threats. The method comprises the steps of activating a quick-release lever, the quick-release lever is accessible to a user while the furniture inlay personal protection shield is secured in furniture predefined opening.

Continuing by removing the furniture inlay personal protection shield from the furniture, by way of the user operates the quick-release lever to release an inlay interlock that allows the user to remove the furniture inlay personal protection shield from the furniture. The furniture inlay personal protection shield comprises an exterior surface inlay that is sized and fabricated to fit a predefined opening in the furniture surface. A bullet-resistant inner liner is affixed to the interior side of the exterior surface inlay, and at least one handle is affixed proximate to the bullet-resistant inner liner.

The method continues by orientating the furniture inlay personal protection shield, by way of the handle, in a manner that securely positions the bullet-resistant inner liner between the user and bodily harm threat. And, viewing, by way of the user, bodily harm threat through a one-way viewable bullet-resistant material that is integrated into and away from the perimeter of the exterior surface inlay. The one-way viewable bullet-resistant material is see-through in only one direction providing viewport therethrough such that the user positioned behind the furniture inlay personal protection shield can see bodily harm threat but bodily harm threat cannot see the user.

Additional shortcomings of the prior art are overcome and additional advantages are provided through the provision of a furniture inlay personal protection shield that is removable from furniture to provide personal protection, in an emergency, from bodily harm threats. The furniture inlay personal protection shield comprises an exterior surface inlay that is sized and fabricated to fit into a predefined opening in the furniture surface. A bullet-resistant inner liner is affixed to the interior surface of the exterior surface inlay. At least one handle is affixed proximate to the bullet-resistant inner liner where a user can, by way of the handle, securely position the bullet-resistant inner liner between the user and bodily harm threat. And, an ammunition impact sensor is located proximate to the bullet-resistant inner liner. A control system comprises a microcontroller, a memory, a communication interface, and the ammunition impact sensor. The memory, the communication interface, and the ammunition impact sensor are operationally related to the microcontroller. The memory is encoded with instructions that when executed by the microcontroller perform the following steps of determining, by way of the ammunition impact sensor, that at least one bullet impacted the bullet-resistant inner liner. And communicating, by way of the communication interface, a bullet alert notification to a remote data processing resource.

System and computer program products corresponding to the above-summarized methods are also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
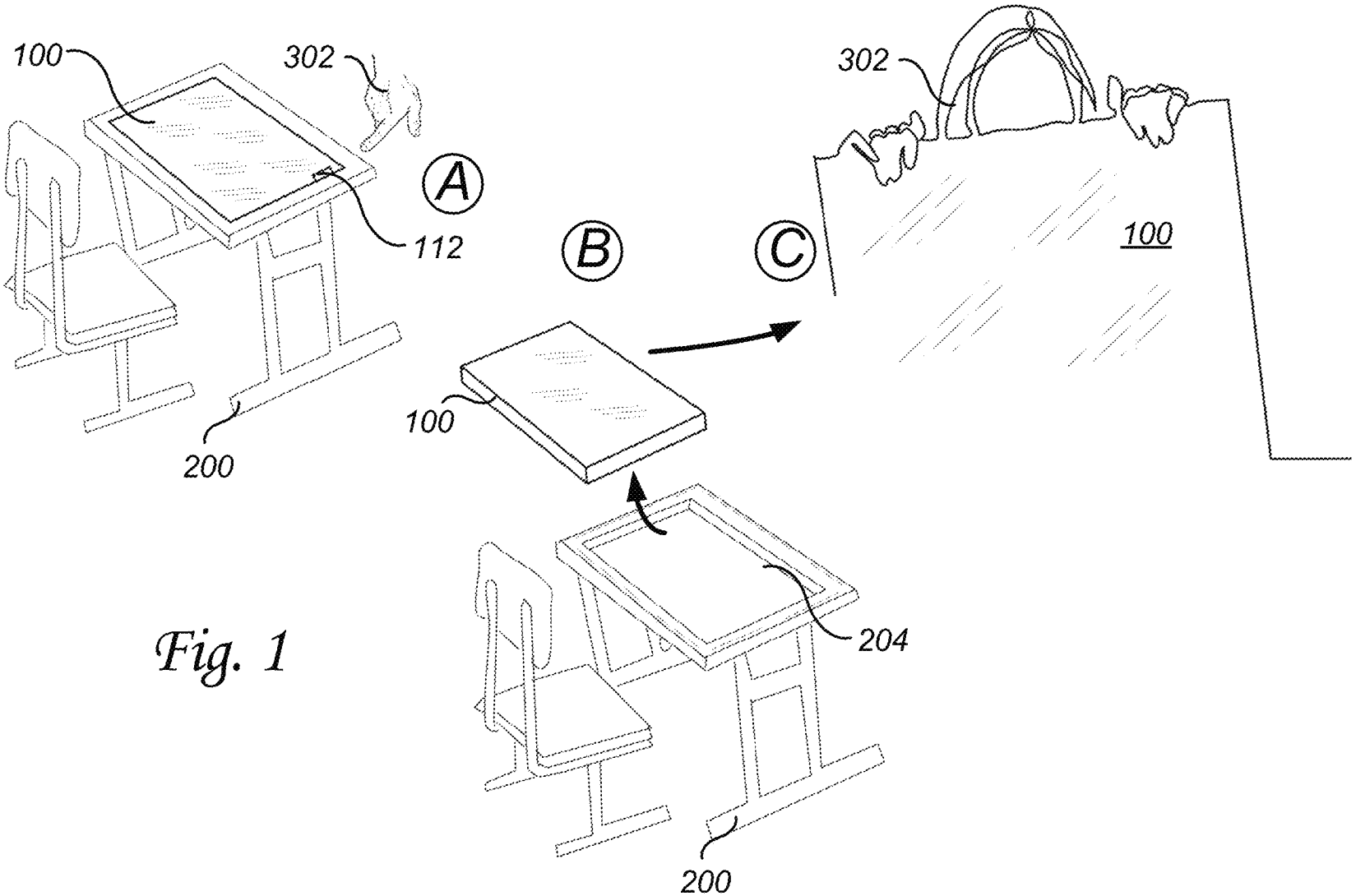
FIG. 1 illustrates one example of a furniture inlay personal protection shield.

Turning now to the drawings in greater detail, it will be seen that in FIG. 1 there is illustrated one example of a furniture inlay personal protection shield 100. In an exemplary embodiment, while being removable by a user 302, the furniture inlay personal protection shield 100 is inlaid and secured into a piece of furniture 200. Such furniture can be, for example, and not a limitation, a desk, a chalkboard or a whiteboard, a door, a floormat for a desk chair, a file cabinet, a refrigerator, or other types and kinds of furniture, as may be required and/or desired in a particular embodiment.

In an exemplary embodiment, FIG. 1 illustrates a school desk furniture 200 that is configured with a furniture inlay personal protection shield 100. During normal use, reference 'A', the furniture inlay personal protection shield 100 serves as the desktop surface where students/user 302 and others using the desk work on the top surface. Reference 'B', in the event of a bodily harm threat which in the present invention is intended to mean harm to human life such as an active shooter situation, a workplace violence event, shelter in place alarm, or other type or kind of potential bodily harm threats where protection from the threat is needed, the user 302, by way of, the quick-release lever 112 can remove the furniture inlay personal protection shield 100 from the desk and take a defensive position using it as a bullet-resistant shield. In this regard, as illustrated in reference 'C', user 302 can place the shield between themself and the bodily harm threat.

For purposes of disclosure, "bodily harm" or "bodily harm threat", in the present invention, is intended to mean any hurt or injury to a person that interferes with the health or comfort of the person and that is more than merely transient or trifling in nature.

"Active shooter", in the present invention, is intended to mean a person or persons with known or suspected lethal weapons such as guns, knives, explosives, or other lethal weapons known or believed to be actively engaged in killing or attempting to kill people in a populated area.

"Workplace violence", in the present invention, is intended to mean any act or threat of physical violence, harassment, intimidation, known or suspected use of lethal or non-lethal weapons, known or suspected bomb or arson threats, known or suspected use of chemicals as a weapon, or other threatening disruptive behavior that occurs at the workplace. It ranges from threats and verbal abuse to physical assaults and even homicide. It can affect and involve employees, clients, customers, and visitors.

The furniture inlay personal protection shield 100, exterior surface inlay 102 is configured to be stored in a predefined opening 204 in the furniture 200. Removable by way of the quick-release lever 112, the furniture inlay personal protection shield 100 interlocks and is secured into the predefined opening 204 within the furniture 200 by way of inlay interlocks 110 better illustrated in at least FIG. 6, or other suitable means.

In an exemplary embodiment, the exterior surface inlay 102 is manufactured from or covered with material that is of complementary design to furniture surface or finishes providing form, fit, and function in accordance with intended furniture appearance and use on the furniture. In this regard, the exterior surface inlay 102 is intended to blend in with the design of the furniture.

For disclosure purposes, while an exemplary embodiment might focus on a particular type of furniture, such as a desk in FIG. 1, the furniture inlay personal protection shield 100 can be any inlaid into a large variety of furniture types and kinds, including desks, tables, cabinets, doors, filing cabinets, lockers, wall décor, and other types or kinds of furniture, as may be required and/or desired in a particular embodiment. Additionally, the furniture inlay personal protection shield 100 can be used in homes, offices, warehouses, and other type or kinds of properties, as well as in vehicles such as panels in trucks where access to the furniture inlay personal protection shield 100 by the drivers and truck loaders can be swift, in an emergence, while the vehicle is parked.

Figure 2:
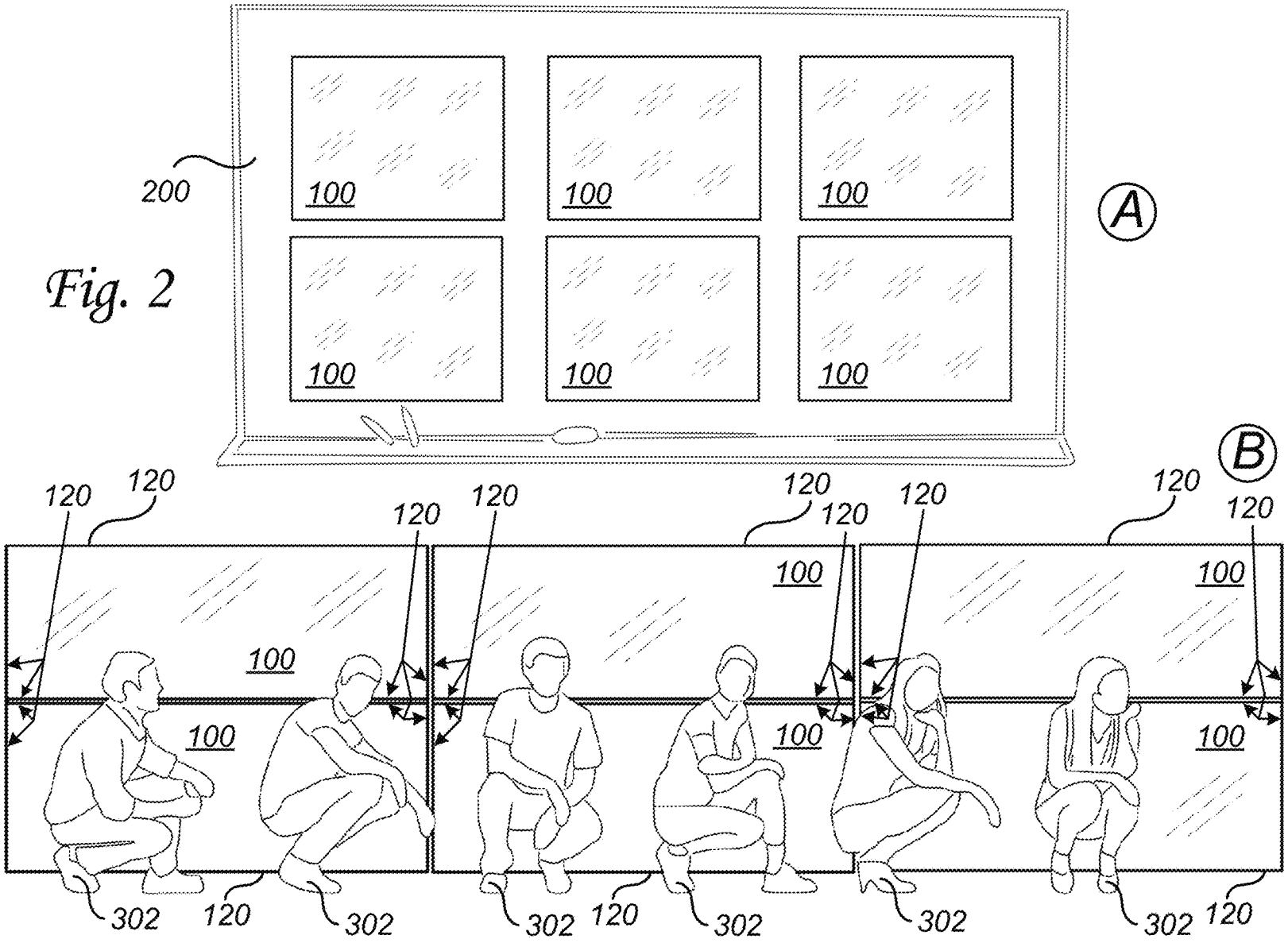
FIG. 2 illustrates one example of a plurality of furniture inlay personal protection shields inlaid into a whiteboard or chalkboard that can be configured as a barricade.

Referring to FIG. 2, there is illustrated one example of a plurality of furniture inlay personal protection shields 100 inlaid into a whiteboard or chalkboard furniture 200 that can be configured as a barricade. In an exemplary embodiment, reference 'A', a plurality of furniture inlay personal protection shields 100 can be inlaid into the same piece of furniture or several different pieces of furniture 200 in the same general location. In this example, a whiteboard or chalkboard commonly found in classrooms, conference rooms, office spaces, warehouses, and other places can be configured to have more than one of the furniture inlay personal protection shield 100.

During a bodily harm threat event, a plurality of furniture inlay personal protection shields 100 can be removed from the whiteboard or chalkboard furniture and interconnecting together, as illustrated in reference 'B', to form a barricade where a plurality of users 302 can take refuge behind.

In an exemplary embodiment, the plurality of furniture inlay personal protection shields 100 can be interconnected, by way of, edge interlocks 120 that are disposed around the perimeter edge of each of the furniture inlay personal protection shield 100, exterior surface inlay 102. One example of an edge interlock 120 can be contoured edging around the perimeter of the furniture inlay personal protection shield 100. In this regard, a 'U' shaped notch opening can be cut on one edge of the exterior surface inlay 102 to receive a 'V' shaped pointed edge cut on an opposing edge so that the two edges interconnect and mate. Alternatively, the furniture inlay personal protection shield 100, edge interlock 120 can be and/or make use of the inlay interlock 110 configured to connect with adjacent furniture inlay personal protection shield 100 interlocking them together to form the barricade. In a plurality of other exemplary embodiments, the edge interlock 120 can be configured in different ways, as may be required and/or desired in a particular embodiment.

In an exemplary embodiment, in operation, one or more edge interlocks 120 are disposed proximate to the edge of the exterior surface inlay 102 and configured to interconnect the exterior surface inlay 102 with a plurality of other furniture inlay personal protection shields 100 forming a barricade in which more than one of the user 302 can assume protected positions by positioning the barricade between the user 302 and the bodily harm threat.

Figure 3:
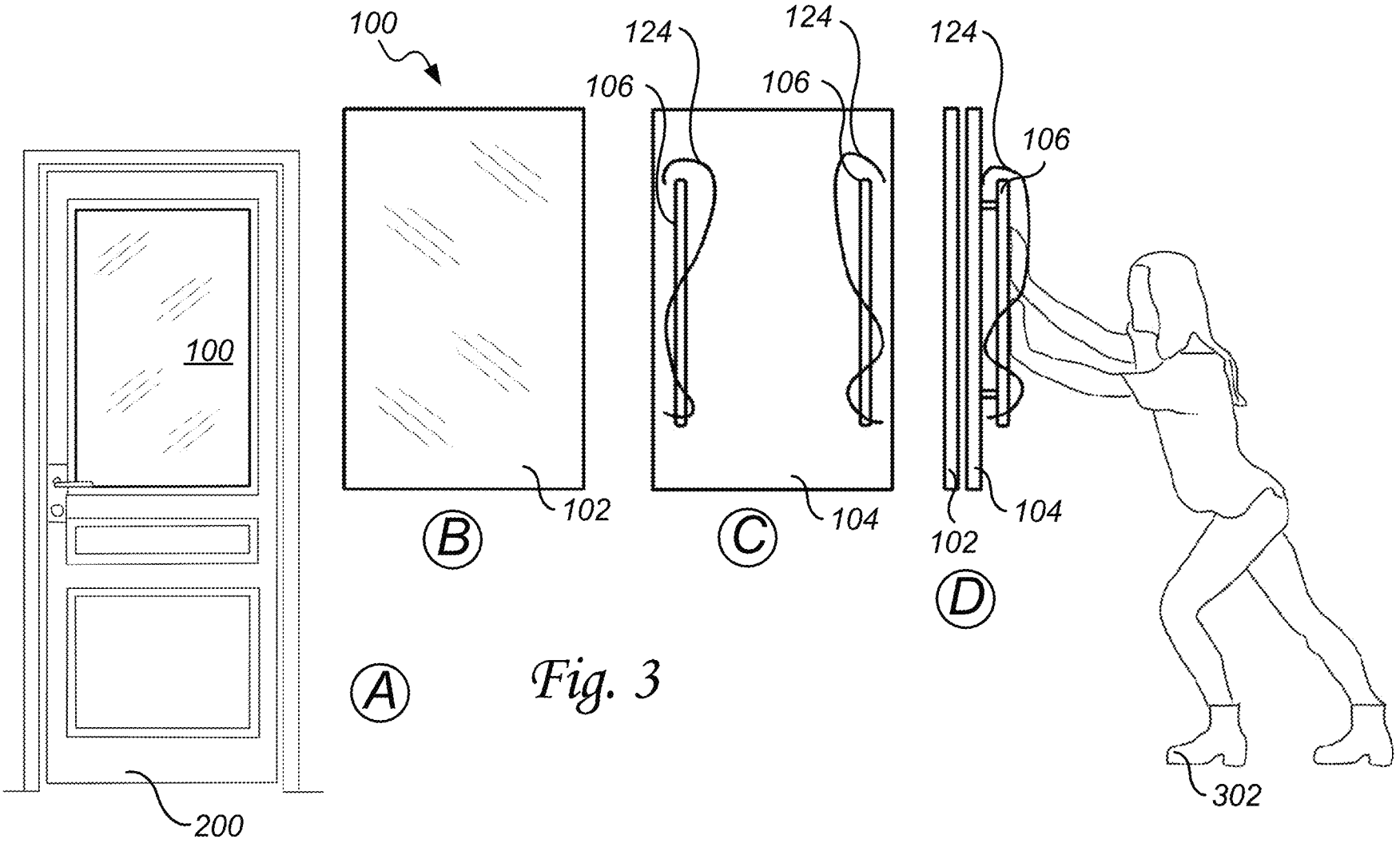
FIG. 3 illustrates one example of a furniture inlay personal protection shield assembly.

Referring to FIG. 3, there is illustrated one example of a furniture inlay personal protection shield 100 assembly. In an exemplary embodiment, reference 'A', the furniture inlay personal protection shield 100 can be inlaid into door furniture 200 and removed by a user 302.

The furniture inlay personal protection shield 100 comprises an exterior surface 102, illustrated in the front-view reference 'B', that is sized and fabricated to fit into a predefined opening in the furniture 200 surface. Rearview reference 'C' illustrates a bullet-resistant inner liner 104 affixed to the interior surface of the exterior surface inlay 102. At least one handle 106 is affixed proximate to the bullet-resistant inner liner 104 where a user 302 can, by way of the handle 106, securely position the bullet-resistant inner liner 104 between the user 302 and the bodily harm threat, as illustrated in reference 'D'.

The furniture inlay personal protection shield 100 can further comprise, one or more carry straps 124. The carry straps 124 can be affixed to the backside of the furniture inlay personal protection shield 100 and are accessible when the furniture inlay personal protection shield 100 is removed from furniture 200 by the user 302. The carry strap 124 allows the user 302 to wear the furniture inlay personal protection shield 100 like a backpack. This can make it easier to carry as well as provide protection when user 302 is running from the bodily harm threat, protecting their back as they flee the threat area.

In an exemplary embodiment, one or more carry strap 124 can be affixed to the backside of the furniture inlay personal protection shield such as affixed to the exterior surface inlay or the bullet-resistant inner liner, and accessible to user 302 when the furniture inlay personal protection shield is removed from furniture 100 by user 302.

In an exemplary embodiment, the bullet-resistant inner liner material can be selected and benchmarked for use against the National Institute of Justice (NIJ) ballistic level standards. The NIJ ballistic level standards are as follows:

NIJ Level IIA|NIJ Level IIA armor is typically soft body armor, meaning that it is composed of layers of high-strength woven fibers. Common types of these fibers are aramid fibers such as TEGRIS, KEVLAR, TWARON, and GOLDFLEX or Polyethylene fibers such as SPECTRA and DYNEEMA. Level IIA is designed to stop a .9 mm FMJ (Full Metal Jacket) round at a speed of ~1165 feet per second (ft/s) and a .40 S&W FMJ at 1065 ft/s. Most often found in soft body armor vests, Level IIA is usually the lightest, most flexible, most comfortable, and easiest to conceal.

NIJ Level II|A step above Level IIA is Level II which is also most commonly soft body armor. Level II is designed to protect from .9 mm FMJ traveling at a speed of ~1245 ft/s and a .357 Magnum JSP (Jacketed Soft Point) at 1,430 ft/s. Like IIA, Level II body armor is typically very light, comfortable, and easy to conceal, however, it provides significantly more protection against blunt force trauma (trauma caused by the kinetic energy of the round hitting the plate or vest). Because of this factor most concealable body armor vests are either Level II or Level IIIA, with Level IIA falling largely out of date.

NIJ Level IIIA|Level IIIA is designed to stop .357 Sig FMJ FN (Flat Nose) bullets traveling at a velocity of ~1470 ft/s and .44 Magnum SJHP (Semi Jacketed Hollow Point) rounds at a velocity of 1430 ft/s. Like its level IIA and Level II, Level IIIA is most commonly soft armor, however hard armor plates and ballistic shields can sometimes be found with a rating of level IIIA.

NIJ Level III|At Level III, there is a transition from soft body armor vests to the world of ballistic plate levels. Ballistic body armor plates are also referred to as rifle plates or hard armor plates. Level III rifle plates are designed to stop 6 spaced hits of 7.62×51 mm NATO FMJ (U.S. Military designation M80) at a velocity of ~2780 ft/s, which is very similar to the .308 Winchester round often used in hunting. Some manufacturers also offer hard armor rifle plates that are referred to as level III+. While the NIJ does not recognize the rating of level III+, these plates typically have the + to indicate that they stop the same rounds at higher velocities or to indicate protection from NIJ threat level III plus additional threats such as M855 and M193. Level III and III+ body armor plates can be found at a variety of different price points depending on the rifle plate's weight and material. The cheapest and heaviest of these options are typically steel body armor plates which can weigh anywhere from 8-10 lbs depending on the size of the plate. While more expensive options such as those made from Polyethylene or ceramic can weigh as little as 3 pounds.

NIJ Level IV|Level IV ballistic plates are the highest-rated hard armor plates under NIJ 101.06 standards. These hard armor plates were designed to take one hit from an armor-piercing rifle. These rifle plates are tested to defeat 7.62 MM armor-piercing (AP) bullets (also known as .30-06 or 30 of 6) traveling at a velocity of 2880 ft/s. Note that since level IV ballistic plates are only tested to stop one shot compared to six shots from a level III hard armor plate, a level IV hard armor plate is not always better than a level III hard armor plate. Besides NIJ certification there are other standards of bullet resistance such as the U.S. Military's SAPI (Small Arms Protective Insert) standards, which feature plates designed to military specifications. This standard first came into play with their Interceptor body armor (IBA), and later with their Improved Outer Tactical Vest (IOTV) and the Modular Tactical Vest (MTV). Since 2005, they have moved to the ESAPI (Enhanced SAPI) Program. There are also what are referred to as Special Threats plates which are designed to stop common threats while minimizing weight and cost. Typically examples of these plates are AK-47 and AR-15 plates.

In an exemplary embodiment, the bullet-resistant inner liner 104 is configured to meet at least one of the National Institute of Justice (NIJ) standards of level IIA, level II, level IIIA, level III, or level IV and preferably the bullet-resistant inner liner 104 is configured to meet NIJ standards of level IIIA or higher.

In another exemplary embodiment, the bullet-resistant inner liner 104 is configured to stop .9 mm full metal jacket bullet traveling at a velocity of less than 1245 feet per second, .357 full metal jacket flat nose bullet traveling at a velocity of less than 1470 feet per second, and .44 magnum semi-jacketed hollow point bullet traveling at a velocity of less than 1430 feet per second.

In an exemplary embodiment, an advantage of the present invention is that the exterior surface of the exterior surface inlay 102 can be covered in the same type of material as the furniture it is being inlaid into. In this regard, the exterior surface of the exterior surface inlay 102 can be covered in wood, FORMICA, whiteboard or chalkboard material, paint, fabric, or other material so that when it is inlaid into the furniture it appears as a normal part of the furniture. In this regard, the exterior surface inlay 102 is manufactured from or exterior surface covered with material that is of complementary design to furniture 200 surface or finish providing form, fit, and function in accordance with the intended furniture 200 appearance and use.

Figure 4:
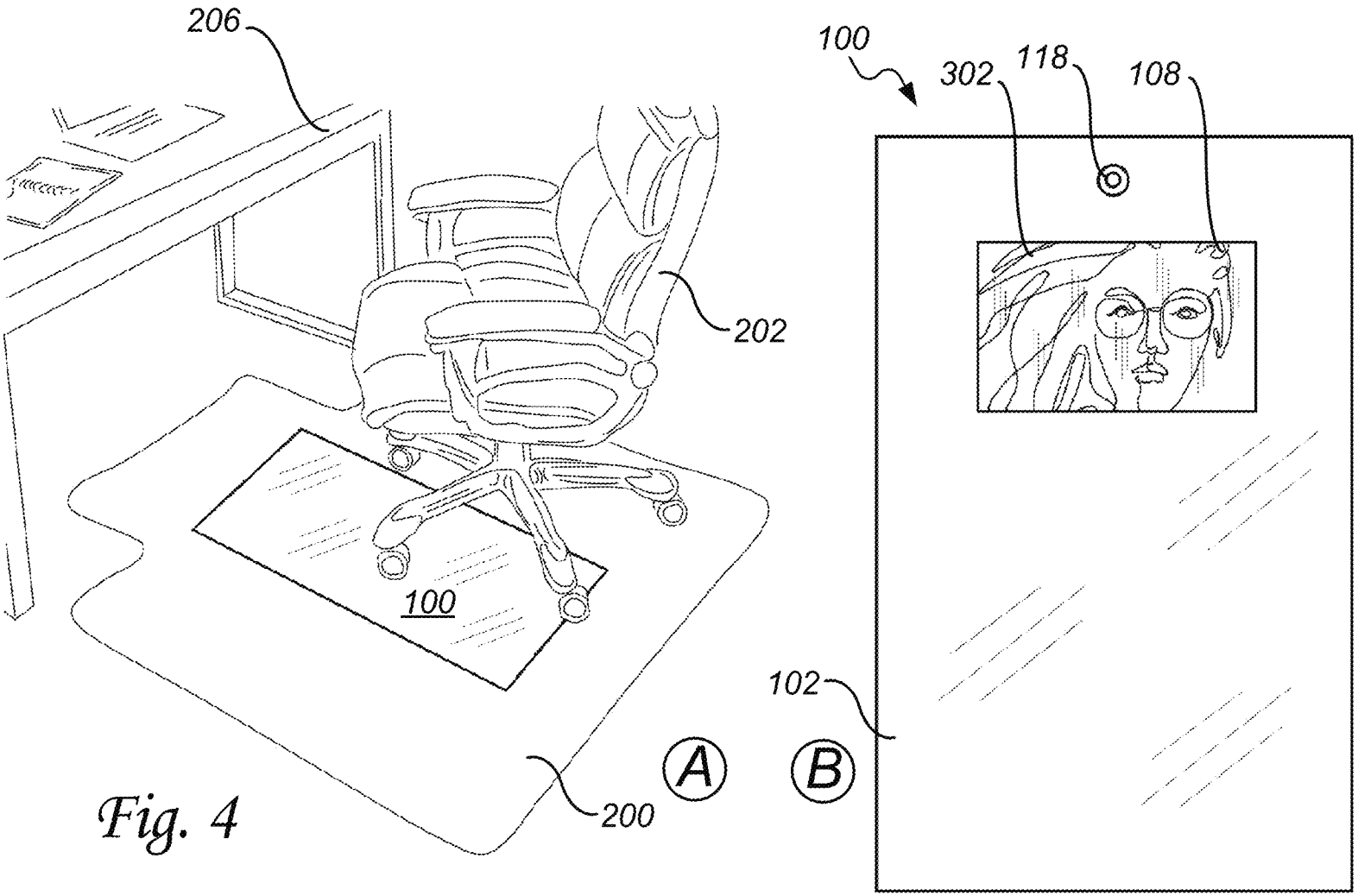
FIG. 4 illustrates one example of a furniture inlay personal protection shield comprising a viewing port and a camera.

Referring to FIG. 4, there is illustrated one example of a furniture inlay personal protection shield comprising a viewing port 108 and a camera 118. In an exemplary embodiment, illustrated in reference 'A', the furniture inlay personal protection shield 100 can be inlaid into a floormat furniture 200 typically used under a desk chair 202, proximate to a desk 206. The furniture inlay personal protection shield 100 is removable by a user 302.

Reference 'B' illustrates user 302 taking up a defensive position, positioning the furniture inlay personal protection shield 100 between the user 302 and the bodily harm threat, the furniture inlay personal protection shield 100 can further comprise a viewport 108 and a camera 118.

In operation, the viewport 108 can be a clear bullet-resistant material or a one-way viewable bullet-resistant material fitted into an opening cut in at least the exterior surface inlay 102 and the bullet-resistant inner liner 104. The openings are aligned such that a clear bullet-resistant viewport 108 or the one-way viewable bullet-resistant material 108 can be installed in a manner that allows user 302 to see through the furniture inlay personal protection shield 100 from the backside to observe the activity in front of the shield, namely in the vicinity of the bodily harm threat.

In an exemplary embodiment, a one-way film can be applied to the clear bullet-resistant material to create a one-way viewable bullet-resistant material.

In an exemplary embodiment, a furniture inlay personal protection shield 100 can be removable from furniture to provide personal protection, in an emergency, from bodily harm threats, the furniture inlay personal protection shield 100 comprises an exterior surface inlay 102 that is sized and fabricated to fit into a predefined opening in furniture 200 surface. A bullet-resistant inner liner 104 is affixed to the interior surface of the exterior surface inlay 102. A one-way viewable bullet-resistant material 108 is integrated into and away from the perimeter of the exterior surface inlay 102. The one-way viewable bullet-resistant material 108 is see-through in only one direction providing a viewport 108 therethrough such that a user 302 positioned behind the furniture inlay personal protection shield 100 can see the bodily harm threat but the bodily harm threat cannot see the user 302. And, at least one handle 106 is affixed proximate to the bullet-resistant inner liner 108 where a user can, by way of the handle 106, securely position the bullet-resistant inner liner 108 between the user 302 and the bodily harm threat.

In this regard, a user 302 can see what is happening in from of the furniture inlay personal protection shield 100 by way of the viewport 108 looking through the one-way viewable bullet-resistant material 108 but the one-way nature of the viewport 108 prevents the bodily harm threat from being able to see the user 302 behind the furniture inlay personal protection shield 100 through the viewport 108.

Furthermore, the furniture inlay personal protection shield 100 can comprise a camera 118 that provides pictures, video, and/or audio of the area proximate to the user 302, the furniture inlay personal protection shield 100, and the vicinity of the bodily harm threat. In an exemplary embodiment, the pictures, video, and/or audio can be recorded locally at the furniture inlay personal protection shield 100 and/or wirelessly data communicated to remote data processing resources 504 and/or data communicating devices 506 by way of the camera 118, camera and/or the shield control system 600 are illustrated in at least FIG. 7.

In an exemplary embodiment, the memory 614 can be encoded with instructions that when executed by the microcontroller 602 perform the steps of communicating, by way of the communication interface 604 audio or video including audio or video from the user 302 to a remote data processing resource 504 in a manner that is accessible by a central control agency 304. And, receiving audio or video intended for the user 302, by way of the remote data processing resource 504, from the central control agency 304.

Such bullet-resistant viewport 108 materials can include optically clear aluminum materials, polycarbonate materials, ballistic glass, one-way viewable materials, or other types or kinds of bullet-resistant viewport materials, as may be required and/or desired in a particular embodiment.

In an exemplary embodiment, a clear bullet-resistant material integrated into the exterior surface inlay 102 provides a viewport 108 therethrough when a user 302 is holding the furniture inlay personal protection shield 100.

In another exemplary embodiment, more than one clear bullet-resistant material is integrated into each of the exterior surface inlay 102 and bullet-resistant inner layer 104, each of the clear bullet-resistant materials is aligned providing a viewport 108 therethrough when a user 302 is holding the furniture inlay personal protection shield 100.

Figure 5:
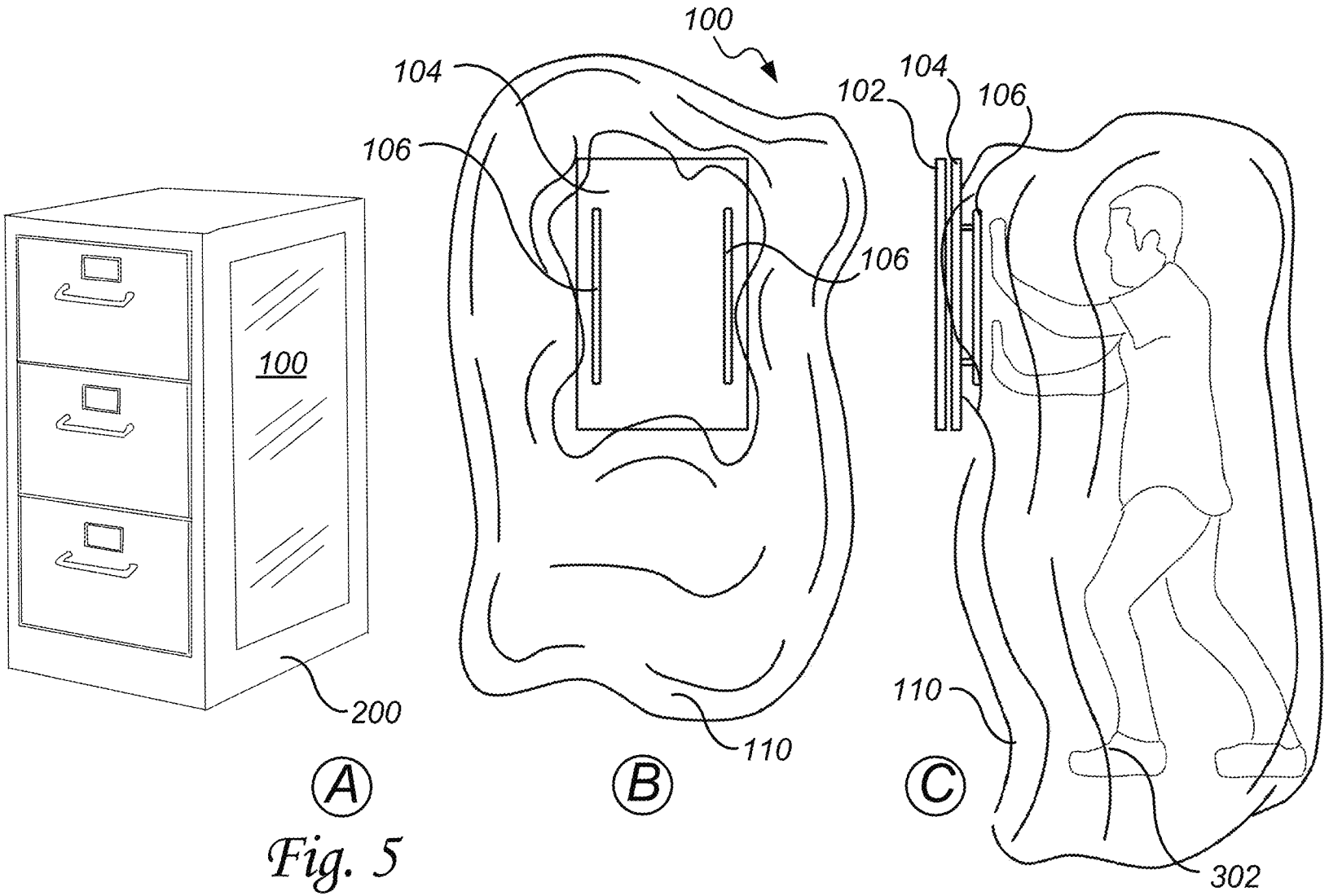
FIG. 5 illustrates one example of a furniture inlay personal protection shield comprising an apron that folds out forming a protective blanket.

Referring to FIG. 5, there is illustrated one example of a furniture inlay personal protection shield 100 comprising an apron 122 that folds out to form a bullet-resistant protective blanket. In an exemplary embodiment, reference 'A' illustrates the furniture inlay personal protection shield 100 inlaid into a file cabinet or other cabinet furniture 200.

In this exemplary embodiment, reference 'B' rearview, when the furniture inlay personal protection shield 100 is removed from the furniture 200, the user can unfold a bullet-resistant apron 122 to extend the protected area beyond the rigid shield itself. The apron 122 can be fastened to the exterior surface inlay 102 and/or fasten to, integrated with, or otherwise be manufactured as part of bullet-resistant inner liner 104.

In operation, the apron 122 is rolled up and stored as part of the backside of the furniture inlay personal protection shield 100 which is concealed when the furniture inlay personal protection shield 100 is inlaid in furniture 200. When user 302 removes the furniture inlay personal protection shield 100 the apron 122 can be unfolded by user 302 forming a bullet-resistant blanket that extends the protected area that one or more user 302 can take refuge under and behind to protect themselves from the bodily harm threat.

Reference 'C' illustrates how the apron 122 can be flexible and formable around one or more user 302 using the furniture inlay personal protection shield 100, the bullet-resistant apron provides additional protection on all sides of the user 302 sides, legs, and any other exposed area when the user is in motion or crouched in a defensive position behind the furniture inlay personal protection shield 100. The apron 122 is ideally sized to accommodate at least one user 302, however, larger aprons can be used so that one apron 122 can cover several users 302.

In an exemplary embodiment, the apron 122 can be manufactured from ballistic blanket material, TEGRIS, KEVLAR, TWARON, and GOLDFLEX or Polyethylene fibers such as SPECTRA and DYNEEMA, or other types or kinds of bullet-resistant material, as may be required and/or desired in a particular embodiment.

Figure 6:
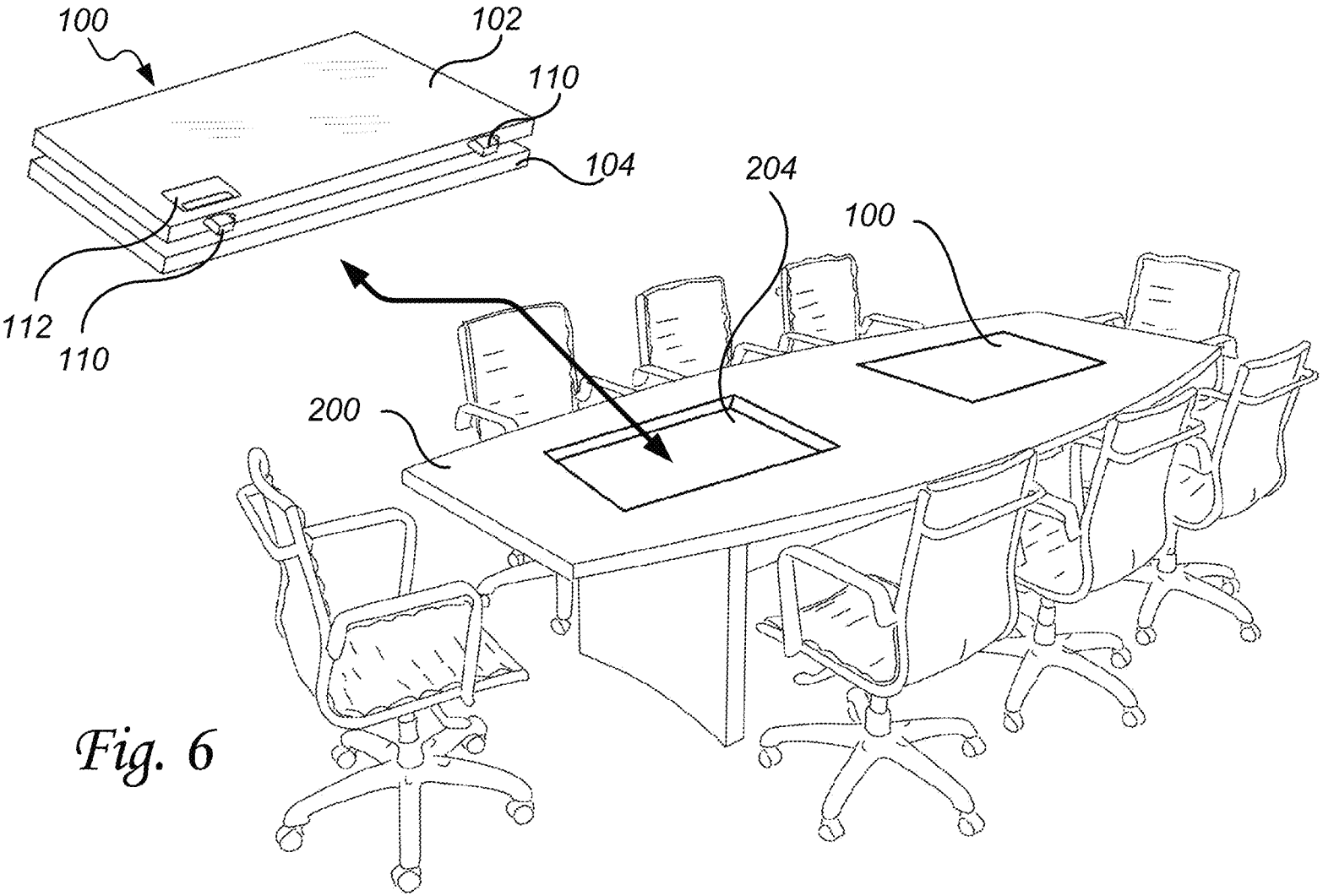
FIG. 6 illustrates one example of a furniture inlay personal protection shield stored as a furniture inlay in a piece of furniture.

Referring to FIG. 6, there is illustrated one example of a furniture inlay personal protection shield 100 stored as a furniture inlay in a piece of furniture 200. In an exemplary embodiment, conference room table furniture 200 like other furniture 200 can have predefined openings 204 cut into the furniture 200 where a furniture inlay personal protection shield 100 can be securely stored. In this regard, furniture inlay personal protection shield 100 can be fabricated to fit into the predefined opening 204 completing the furniture surface.

The furniture inlay personal protection shield 100, exterior surface inlay 102, can be configured with one or more inlay interlocks 110. When the furniture inlay personal protection shield 100 is placed into the predefined opening 204 the inlay interlocks 110 secures the furniture inlay personal protection shield 100 into place. To remove the furniture inlay personal protection shield 100, from the predefined opening 204, a user 302 can activate or otherwise operate the quick-release lever 112 which disengages the inlay interlocks 110 allowing the furniture inlay personal protection shield 100 to be removed from the furniture 200, predefined opening 204.

Figure 7:
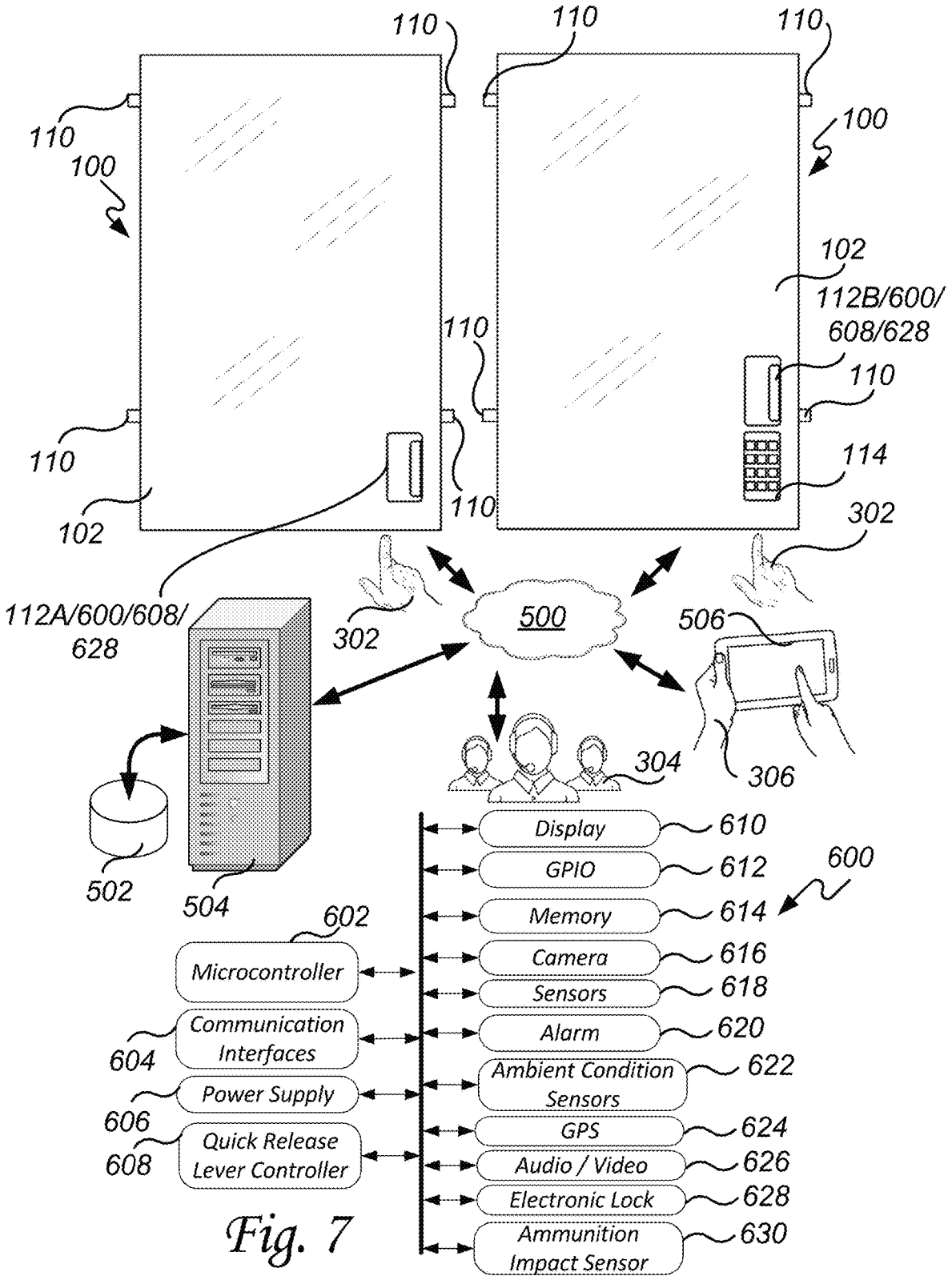
FIG. 7 illustrates examples of furniture inlay personal protection shield quick-release lever, and shield control system features.

Referring to FIG. 7, there are illustrated examples of a furniture inlay personal protection shield 100, quick-release lever 112, and shield control system 600 features. In an exemplary embodiment, the furniture inlay personal protection shield 100 can be web-enabled and data communicates across a global communication network 500. A global communication network 500 can be the Internet. In this regard, the furniture inlay personal protection shield 100 can further comprise the shield control 600.

The term "web-enabled" or "web-enabled control system" or "web-enabled control system 600", in the present invention, is intended to mean an Internet-of-things device. In this regard, a device that is capable of connecting a physical device such as the furniture inlay personal protection shield 100 to the digital world. Stated differently, web-enabling is equipping a device with the necessary electronics to be monitored, controlled, and data communicate locally and remotely with other data communicating devices. Such other data communicating devices 506 can be smartphones, tablets, laptops, other web-enabled devices, servers, and similar devices.

In addition, such data communication devices 506 and the furniture inlay personal protection shield 100 equipped with a shield control system 600 can data communicate with remote data processing resources 504 and utilize data storage resources 502. Such data processing resources 504 can be a server or other types and kinds of data processing resources. Data storage resources 502 can be a database or other types and kinds of data processing resources. Furthermore, data communication devices 506, remote data processing resources 504, data storage resources 502, and other types and kinds of data communicating devices can data communicate over a global network 500, such as the Internet.

In an exemplary embodiment, the furniture inlay personal protection shield 100 can be equipped with a web-enabled control system 600. Such a web-enabled control system can comprise a microcontroller 602 which is operationally related to a plurality of communication interfaces 604, a power supply 606, a quick-release lever controller 608, a display 610, a general-purpose inputs and outputs (GPIO) interface 612, a memory 614, a camera interface 616, a plurality of sensors 618, an alarm 620, a plurality of ambient condition sensors 622, a global position system device 624, an audio and video transmitting and/or receiving interface 626, an electronic lock controller 628, and an ammunition impact sensor 630.

In an exemplary embodiment, the quick-release lever 112 can be manually interconnected with the inlay interlocks 110 and operated without the aid of the shield control system 600. In this regard, user 302 can manually operate the quick-release lever 112 to retract the inlay interlocks 110 and remove the furniture inlay personal protection shield 100.

In another exemplary embodiment, the shield control system 600 can be incorporated into the furniture inlay personal protection shield 100. In this regard, the quick-release lever 112 can further comprise an electronic lock 628, wherein the electronic lock 628 receives a remote unlock signal data communication unlocking the quick-release lever 112 for use prior to using the quick-release lever 112 to release the inlay interlock 110. FIG. 7 illustrates this combination as 112A/600/608/628, and 112B/600/608/628.

In another exemplary embodiment, a quick-release lever 112 can be configured to be accessible to user 302 while the furniture inlay personal protection shield is secured in furniture predefined opening. The quick-release lever 112 releases the inlay interlock 110 allowing the user 302 to remove the furniture inlay personal protection shield 100 from the furniture. The quick-release lever 112 further comprises an electronic lock 628. A control system 600 comprises a microcontroller 602, a memory 614, a communication interface 604, and the electronic lock 628. The memory 614, the communication interface 604, and the electronic lock 628 are operationally related to the microcontroller 602. The memory 614 can be encoded with instructions that when executed by the microcontroller 602 transition between the steps of receiving a remote unlock signal from a remote data processing resource 504, by way of the communication interface 604, and unlocking the quick-release lever 112, by way of the electronic lock 628, for use prior to using the quick-release lever 112 to release the inlay interlock 110. Or, receiving a remote lock signal from a remote data processing resource 504, by way of the communication interface 604, and locking the quick-release lever 112, by way of the electronic lock 628, to prevent the use of the quick-release lever 112 to release the inlay interlock 110.

The quick-release lever controller 608 can be interconnected with and control the quick-release lever 112. Whereas the electronic lock 628 is responsive to remote data communication to enable or disable the quick-release lever 112, the quick-release lever controller 608 is electrically operatable, provided the electronic lock 628 has unlocked the quick-release lever 112, to actuate the quick-release lever 112 causing the inlay interlocks 110 to retract so that the furniture inlay personal protection shield 100 can be removed from the furniture 200. In an exemplary embodiment, in operation, the electronic lock 628 can be remotely controlled by a central control agency 304 and the quick-release lever 112 actuation can, by way of the quick-release lever controller 608, be controlled by the user 302 using data communicating devices 506. Such a central control agency 304 can be school administration, management, corporate security, federal agencies, law enforcement, and/or other authorized agencies, as may be required and/or desired in a particular embodiment. Such a data communicating device 506 can be a smartphone, laptop, or other data communicating device.

An advantage, in the present invention, is that a control signal from a central control agency 304 such as school administration, management, corporate security, federal agencies, law enforcement, and/or other authorized agencies needs to be data communicated to the furniture inlay personal protection shield 100, shield control system 600 enabling the quick-release lever 112 for release, by way of the electronic lock 628, prior to a user 302 actuating the quick-release lever 112 and removing the furniture inlay personal protection shield 100 from the furniture 200. This safeguard keeps the furniture inlay personal protection shield 100 from being used until a control signal from a central control agency 304 is received.

In operation, this gives the central control agency 304 the ability to remotely lock and unlock the furniture inlay personal protection shield 100 for use by user 302. Such furniture inlay personal protection shield 100 lock periods can be when the school, warehouse, or business are closed and there are no people present. Conversely, such furniture inlay personal protection shield 100 unlock periods can be when the school, warehouse, or business are open and there are people present.

In another exemplary embodiment, the quick-release lever 112 can further comprise a keycode lock 114, wherein the user 302 enters a valid keycode to unlock the quick-release lever 112 prior to using the quick-release lever 112 to release the inlay interlock 110 allowing the furniture inlay personal protection shield 100 to be removed from furniture 200 by the user 302. The keycode lock 114 can be mechanically actuated or interconnected with shield control system 600 by way of GPIO 612 and electrically operated.

In operation, the quick-release lever 112 further comprises the keycode lock, wherein user 302 enters a valid keycode to unlock the quick-release lever 112 prior to using the quick-release lever 112 to release the inlay interlock 110 so that the furniture inlay personal protection shield 100 can be removed from the furniture 200.

The microcontroller 602 can be an INTEL, ZILOG, MICROCHIP, AMD, ARM, and/or other types or kinds of microcontrollers. Operationally related to the microcontroller 602 can be a communication interface 604, a power supply 606, a quick-release lever controller 608, a display 610, a GPIO 612, a memory 614, a camera interface 616, one or more sensors 618, an alarm 620, one or more ambient condition sensors 622, a global positioning system (GPS) device 624, an audio and video interface 626, an electronic lock 628, and an ammunition impact sensor 630.

The communication interfaces 604 can be LAN, WAN, USB, Ethernet, RS232, RS485, serial, WiFi, 802.11abgn and similar, 2G 3G 4G 5G compatible, Bluetooth, TCP, UDP, Mesh Network, Zigbee, Pico Network, LORAN, and/or other types and kinds of communication interfaces and protocols.

The power supply 606 can be AC, DC, battery, solar, and/or other types and kinds of power supplies.

The quick-release lever controller 608 can be a relay, MOSFET, or other types and kinds of controlling devices.

The display 610 can be an LCD, OLED, LED, and/or other types and kinds of displays.

The GPIO 612 can be TTL, CMOS, transistors, buffers, relays, pushbutton, switch, and/or other types and/or other types and kinds of GPIO circuits.

The memory 614 can be combinations of RAM, ROM, flash, hard drives, solid-state drives, USB flash drives, and/or other types and kinds of memory.

The camera interface 616 can be interconnected with camera 118 and integrated into the furniture inlay personal protection shield 100. Also, several cameras can be utilized to create a network of camera views that can monitor a broader area. Such multiple camera applications can include some that are integrated into the furniture inlay personal protection shield 100 and some that are remote from the furniture inlay personal protection shield 100. Web-enabled camera 118 can interface to and data-communicate with the camera interface 616.

The sensors 618 can be PIR motion sensors, infrared, thermal, Doppler radar, ultrasonic, capacitance, touch-type, optical, Hall effect, switch, fingerprint, and other types of biometric sensors, and/or other types and kinds of sensors.

The alarm 620 can be noise lights, relays, siren, horn, piezo buzzer, speaker, voice annunciations, and/or other types and kinds of alarms.

The ambient condition sensors 622 can be temperature, moisture, humidity, sunlight, time, date, and/or other types and kinds of sensors.

The global positioning system (GPS) device 624 can be used to determine the geographic location of the furniture inlay personal protection shield 100.

The audio and video interface 626 can be used to interconnect with a plurality of audio microphones and other sources of audio and video signal sources.

The electronic lock 628 can selectively receive user input and/or be a relay, MOSFET, or other types and kinds of controlling devices.

In operation, in an exemplary embodiment, the furniture inlay personal protection shield 100 can be equipped with a web-enabled control system 600 so that the furniture inlay personal protection shield 100 can be remotely monitored and controlled. Such remote monitoring and control can be effectuated by the central control agency 304, the user 302 by way of data communicating devices 506, and/or others as may be required and/or desired in a particular embodiment.

An ammunition impact sensor 630 can be located proximate to the bullet-resistant inner liner 104. The ammunition impact sensor measures the impact of a projectile such as a bullet hitting the bullet-resistant liner 104. Such an ammunition impact sensor can be a vibration sensor, an inductance type sensor, a strain gauge type sensor, a force gauge type sensor, or other types and kinds of ammunition impact sensors as may be required and/or desired in a particular embodiment.

In operation, the control system 600 comprises a microcontroller 602, a memory 614, a communication interface 604, and the ammunition impact sensor 630. The memory 614, the communication interface 604, and the ammunition impact sensor 630 are operationally related to the microcontroller 60. The memory 614 can be encoded with instructions that when executed by the microcontroller 602 perform the steps of determining, by way of the ammunition impact sensor 630, at least one of a bullet impacted the bullet-resistant inner liner 104 and communicating, by way of the communication interface 604, a bullet alert notification to the remote data processing resource 504. In addition, such bullet alert notification can include a bullet impact telemetry such as impact force, direction of impact, the temperature of the impact site, impact speed such as feet per second, and other bullet impact telemetry as may be required and/or desired in a particular embodiment.

In addition, such remote monitoring control can be by way of data communicating devices 506 or remote data processing resource 504. Furthermore, furniture inlay personal protection shield 100 can be operated manually, by hand, illustrated as user 302 and/or through a quick-release lever 112 and/or keycode lock 114, when so configured.

Figure 8:
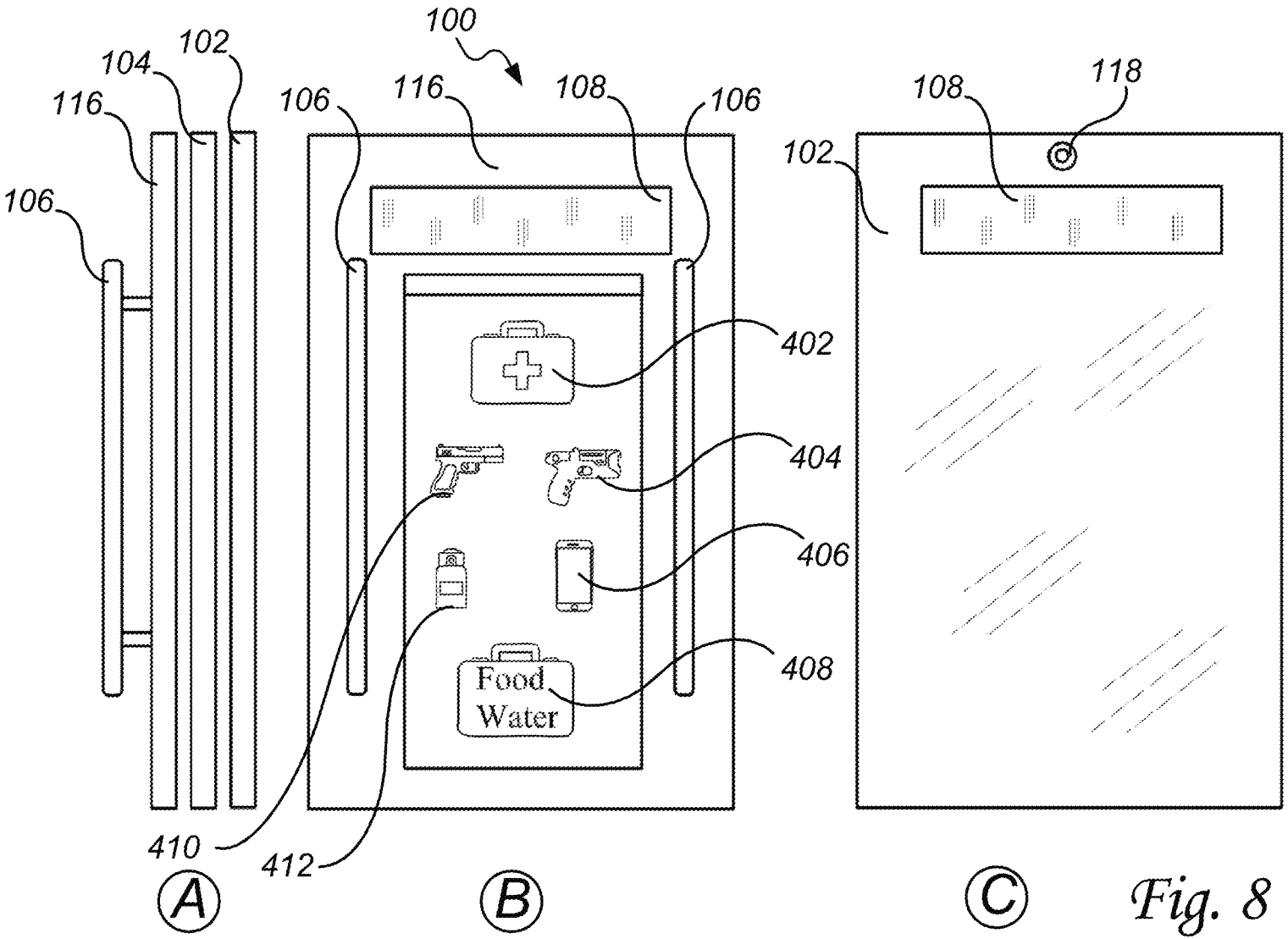
FIG. 8 illustrates one example of a furniture inlay personal protection shield comprising a self-defense compartment.

Referring to FIG. 8, there is illustrated one example of a furniture inlay personal protection shield 100 comprising a self-defense compartment 116. In an exemplary embodiment, a self-defense compartment 116 can be interconnected on the backside of the furniture inlay personal protection shield 100 proximate to the bullet-resistant inner liner 104. The self-defense compartment 116 can include one or more of the following: a lethal weapon 410 such as a gun and/or other lethal weapons, a non-lethal weapon 404 such as a Taser and/or other non-lethal weapons, a self-defense spray 412 such as pepper spray and/or other self-defense sprays, a digital communication device 406 such as a smartphone, laptop, and/or other computing devices, a plurality of medical supplies 402 such as tunicates, bandages, drugs and/or other medical supplies, or a plurality of food or water supplies 408.

In operation, a user 302 while taking defensive shelter behind the furniture inlay personal protection shield 100 can access offensive weapons to thwart the bodily harm threats. In addition, the user 302 can access medical and food/water supplies to treat themselves as well as other users 302 that need attention during the bodily harm threat event and/or in the immediate aftermath of the event.

Reference 'A' illustrates a side view of the furniture inlay personal protection shield 100 showing the exterior surface inlay 102, the bullet-resistant inner liner 10, and the self-defense compartment 116 interconnections.

Reference 'B' illustrates the rearview of the furniture inlay personal protection shield 100 showing the self-defense compartment 116 that includes access to a lethal weapon 410, a non-lethal weapon 404, a self-defense spray 412, a digital communication device 406, a plurality of medical supplies 402, or a plurality of food or water supplies 408. Also illustrated is viewport 108 through which a user 302 positioned behind the furniture inlay personal protection shield 100 can view the vicinity in front of the furniture inlay personal protection shield 100.

Reference 'C' illustrates a front view of the furniture inlay personal protection shield 100 showing the exterior surface inlay 102, the viewport 108, and the camera 118.

Figure 9:
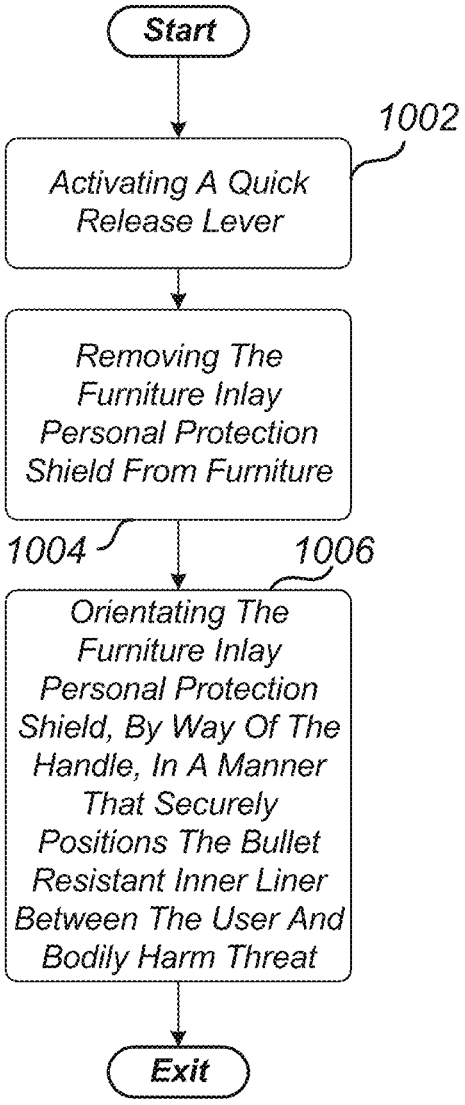
FIGS. 9-10 illustrate examples of a method of using a furniture inlay personal protection shield that is removable from furniture to provide personal protection, in an emergency, from bodily harm threats.

Referring to FIG. 9, there is illustrated one example of a method of using a furniture inlay personal protection shield 100 that is removable from furniture 200 to provide personal protection, in an emergency, from bodily harm threats. The method begins in step 1002.

In step 1002, a quick-release lever 112 is activated or otherwise operated by user 302. The quick-release lever 112 is accessible to a user 302 while the furniture inlay personal protection shield 100 is secured in a furniture 200 predefined opening. The method moves to step 1004.

In step 1004, the furniture inlay personal protection shield 100 is removed by user 302 from the furniture 200, by way of the quick-release lever 112 releasing an inlay interlock 110 allowing user 302 to remove the furniture inlay personal protection shield 100 from the furniture 200. The furniture inlay personal protection shield 100 comprises an exterior surface inlay 102 sized and fabricated to fit the predefined opening in the furniture 200 surface, a bullet-resistant inner liner 104 is affixed to the exterior surface inlay 102, and at least one handle 106 is affixed proximate the bullet-resistant inner liner 104. The method moves to step 1006.

In step 1006, the furniture inlay personal protection shield 100 is orientated, by way of the handle 106, in a manner that securely positions the bullet-resistant inner liner 104 between the user 302 and the bodily harm threat. The method is then exited.

Figure 10:
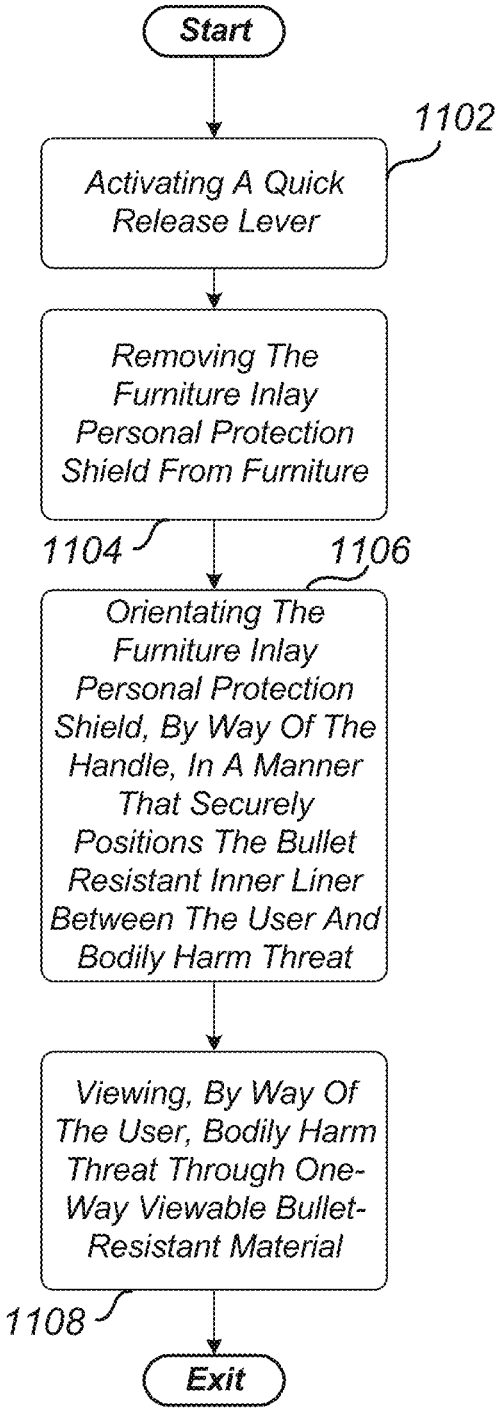

Referring to FIG. 10, there is illustrated one example of a method of using a furniture inlay personal protection shield 100 that is removable from furniture 200 to provide personal protection, in an emergency, from bodily harm threats. The method begins in step 1102.

In step 1102, a quick-release lever 112 is activated or otherwise operated by user 302. The quick-release lever 112 is accessible to a user 302 while the furniture inlay personal protection shield 100 is secured in a furniture 200 predefined opening. The method moves to step 1104.

In step 1104, the furniture inlay personal protection shield 100 is removed by user 302 from the furniture 200, by way of the quick-release lever 112 releasing an inlay interlock 110 allowing user 302 to remove the furniture inlay personal protection shield 100 from the furniture 200. The furniture inlay personal protection shield 100 comprises an exterior surface inlay 102 sized and fabricated to fit the predefined opening in the furniture 200 surface, a bullet-resistant inner liner 104 is affixed to the exterior surface inlay 102, and at least one handle 106 is affixed proximate the bullet-resistant inner liner 104. The method moves to step 1106.

In step 1106, the furniture inlay personal protection shield 100 is orientated, by way of the handle 106, in a manner that securely positions the bullet-resistant inner liner 104 between the user 302 and the bodily harm threat.

In step 1108, viewing, by way of the user 302, the bodily harm threat through a one-way viewable bullet-resistant material 108 that is integrated into and away from the perimeter of the exterior surface inlay 102. The one-way viewable bullet-resistant material 108 is see-through in only one direction providing viewport 108 therethrough such that the user 302 positioned behind the furniture inlay personal protection shield 100 can see the bodily harm threat but the bodily harm threat cannot see the user 302. The method is then exited.

Figure 11:
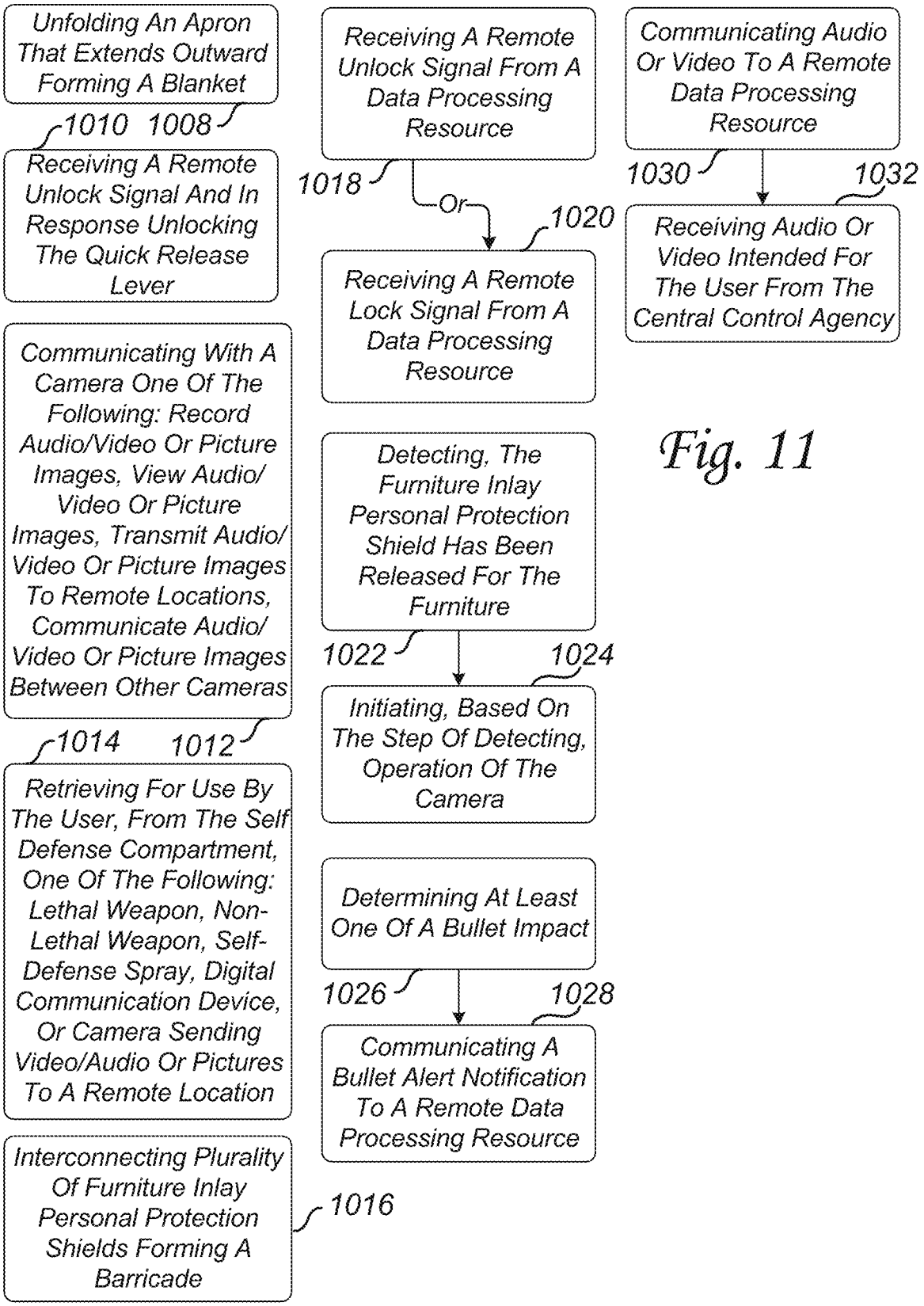
FIG. 11 illustrates exemplary embodiments of using a furniture inlay personal protection shield that is removable from furniture to provide personal protection, in an emergency, from bodily harm threats.

Referring to FIG. 11, there are illustrated exemplary embodiments of using a furniture inlay personal protection shield 100 that is removable from furniture 200 to provide personal protection, in an emergency, from bodily harm threats. Such exemplary embodiments can be interchangeably used with the methods of the present invention.

In step 1008, an apron 122 an apron that is bullet-resistant is unfolded forming a blanket suitable for covering one or more of the user 302, the bullet-resistant inner liner 104 further comprises the apron.

In step 1010, a remote unlock signal is received by the shield control system 600 and in response, the quick-release lever 112 is unlocked so that a user 302 can activate or otherwise operate the quick-release lever 112 to remove the furniture inlay personal protection shield 100 from the furniture 200. Such lock/unlock of the quick-release lever 112 can be by way of the electronic lock, wherein the lock/unlock signal is received from a central control agency 304. Furthermore, the lock/unlock of the quick-release lever 122 can be by way of the quick-release lever controller 608, wherein the lock/unlock signal is received from the user 302 by way of a data communication device 506 such as a smartphone, laptop, or other data communication devices.

In step 1012, communicating with a camera 118, the camera 118 is operationally related to the exterior surface inlay 102, the camera 118 is configured to perform at least one of the following: record audio/video or picture images, view audio/video or picture images received or recorded on a display, transmit audio/video or picture images to remote locations, communicate audio/video or picture images between other cameras located in other remote locations.

In step 1014, retrieving for use by the user 302, from a self-defense compartment 116 that is secured proximate to the bullet-resistant inner liner 104, one or more of the following: a lethal weapon 410, a non-lethal weapon 404, a self-defense spray 412, a digital communication device 406, a plurality of medical supplies 402, or a plurality of food or water supplies 408.

In step 1016, interconnecting a plurality of the furniture inlay personal protection shields 100 forming a barricade in which more than one of the user 302 can assume protected positions, by way of one or more edge interlock disposed proximate edge of the exterior surface inlay and configured to interconnect with other furniture inlays personal protection shield 100.

In step 1018, a quick-release lever 112 is accessible to user 302 while the furniture inlay personal protection shield 100 is secured in furniture 200 predefined opening. The quick-release lever 112 releases the inlay interlock 110 allowing the user 302 to remove the furniture inlay personal protection shield 100 from the furniture 200. The quick-release lever 112 further comprises an electronic lock 628. A control system 600 comprises a microcontroller 602, a memory 614, a communication interface 604, and an electronic lock 628. The memory 614, the communication interface 604, and the electronic lock 628 are operationally related to the microcontroller 602. The memory 614 is encoded with instructions that when executed by the microcontroller 602 transition between steps 1018 and 1020.

In step 1018, a remote unlock signal is received from a remote data processing resource 504, by way of the communication interface 604. In response, the quick-release lever 112 is unlocked, by way of the electronic lock 628, for use prior to using the quick-release lever 112 to release the inlay interlock 110. Or, in step 1020, a remote lock signal is received from the remote data processing resource 504, by way of the communication interface 604, and the quick-release lever 112 is locked, by way of the electronic lock 628, to prevent the use of the quick-release lever 112 to release the inlay interlock 110.

In step 1022, a camera 616 is operationally related to the exterior surface inlay 102. A control system 600 comprises a microcontroller 602, a memory 614, a communication interface 602, and a camera 616. The memory 614, the communication interface 602, and the camera 616 are operationally related to the microcontroller 602. The memory 614 is encoded with instructions that when executed by the microcontroller 602 perform steps 1022 and 1024.

In step 1022, detecting that the furniture inlay personal protection shield has been released from the furniture. The method then moves to step 1024 initiating operation of the camera 616. The camera 616 is configured to perform at least one of the following: record audio/video or picture images, view audio/video or picture images received or recorded on a display, transmit audio/video or picture images to remote locations, communicate audio/video or picture images between other cameras.

In step 1026, an ammunition impact sensor 630 is located proximate to the bullet-resistant inner liner 104. A control system 600 comprises a microcontroller 602, a memory 614, a communication interface 604, and the ammunition impact sensor 630. The memory 614, the communication interface 604, and the ammunition impact sensor 630 are operationally related to the microcontroller 602. The memory 614 is encoded with instructions that when executed by the microcontroller 602 perform steps 1026 and 1028.

In step 1026, determining, by way of the ammunition impact sensor 630, at least one of a bullet impact on the bullet-resistant inner liner 104. The method then moves to step 1028, communicating, by way of the communication interface 604, a bullet alert notification to a remote data processing resource 504.

In step 1030, in an exemplary embodiment, the memory 614 can be encoded with instructions that when executed by the microcontroller 602 perform the steps of communicating, by way of the communication interface 604 audio or video including audio or video from the user 302 to a remote data processing resource in a manner that is accessible by a central control agency 304. The method then moves to step 1032 receiving audio or video intended for the user 302, by way of the control system 600, from the central control agency 304.

The capabilities of the present invention can be physically implemented and goods and/or implemented in software, firmware, hardware, or some combination thereof.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A furniture inlay personal protection shield is removable from furniture to provide personal protection, in an emergency, from bodily harm threats, the furniture inlay personal protection shield comprising:

an exterior surface inlay that is sized and fabricated to fit into predefined opening in furniture surface;

a bullet-resistant inner liner is affixed to interior surface of the exterior surface inlay;

a one-way viewable bullet-resistant material is integrated into and away from perimeter of the exterior surface inlay, the one-way viewable bullet-resistant material is see-through in only one direction providing viewport therethrough such that a user positioned behind the furniture inlay personal protection shield can see bodily harm threat but bodily harm threat cannot see the user;

at least one handle is affixed proximate to the bullet-resistant inner liner where a user can, by way of the handle, securely position the bullet-resistant inner liner between the user and bodily harm threat;

a camera is mounted proximate to the exterior surface inlay;

a control system comprises a microcontroller, a memory, a communication interface, and the camera, the memory, the communication interface, and the camera are operationally related to the microcontroller, the memory is encoded with instructions that when executed by the microcontroller perform the steps of:

detecting that the furniture inlay personal protection shield has been released from furniture; and initiating, based on the step of detecting, operation of the camera, the camera is configured to perform at least one of the following: record audio/video or picture images, view audio/video or picture images received or recorded on a display, transmit audio/video or picture images to remote locations, or communicate audio/video or picture images between other cameras.

2. The furniture in accordance with claim 1, the exterior surface inlay is covered with material that is of similar design to furniture surface providing function as a personal protection shield as well as function as intended furniture appearance and use.

3. The furniture inlay personal protection shield in accordance with claim 1, further comprising:

an inlay interlock is operationally related to the exterior surface inlay, the inlay interlock secures the furniture inlay personal protection shield in furniture predefined opening.

4. The furniture inlay personal protection shield in accordance with claim 3, further comprising:

a quick-release lever accessible to the user while the furniture inlay personal protection shield is secured in furniture predefined opening, the quick-release lever releasing the inlay interlock allowing the user to remove the furniture inlay personal protection shield from furniture, the quick-release lever further comprising a keycode lock, wherein the user enters valid keycode to unlock the quick-release lever prior to using the quick-release lever to release the inlay interlock.

5. The furniture inlay personal protection shield in accordance with claim 3, further comprising:

a quick-release lever is accessible to the user while the furniture inlay personal protection shield is secured in furniture predefined opening, the quick-release lever releasing the inlay interlock allowing the user to remove the furniture inlay personal protection shield from furniture, the quick-release lever further comprising an electronic lock, a control system comprises a microcontroller, a memory, a communication interface, and the electronic lock, the memory, the communication interface, and the electronic lock are operationally related to the microcontroller, the memory is encoded with instructions that when executed by the microcontroller transitions between the steps of:

receiving a remote unlock signal from a remote data processing resource, by way of the communication interface, and unlocking the quick-release lever, by way of the electronic lock, for use prior to using the quick-release lever to release the inlay interlock; or receiving a remote lock signal from the remote data processing resource, by way of the communication interface, and locking the quick-release lever, by way of the electronic lock, to prevent use of the quick-release lever to release the inlay interlock.

6. The furniture inlay personal protection shield in accordance with claim 1, the bullet-resistant inner liner is configured to stop .9 mm full metal jacket bullet traveling at velocity of less than 1245 feet per second, .357 full metal jacket flat nose bullet traveling at a velocity of less than 1470 feet per second, and .44 magnum semi jacketed hollow point bullet traveling at a velocity of less than 1430 feet per second.

7. The furniture inlay personal protection shield in accordance with claim 1, the bullet-resistant inner liner further comprises an apron that is bullet-resistant and unfolds forming a blanket suitable for covering one or more of the user.

8. The furniture inlay personal protection shield in accordance with claim 1, the memory is encoded with instructions that when executed by the microcontroller perform the steps of:

communicating, by way of the communication interface audio or video including audio or video from the user to a remote data processing resource in a manner that is accessible by a central control agency; and receiving audio or video intended for the user, by way of the remote data processing resource, from the central control agency.

9. The furniture inlay personal protection shield in accordance with claim 1, further comprising:

a self-defense compartment is secured proximate to the bullet-resistant inner liner, the self-defense compartment includes one or more of the following: a lethal weapon, a non-lethal weapon, a self-defense spray, a digital communication device, a plurality of medical supplies, or a plurality of food or water supplies.

10. The furniture inlay personal protection shield in accordance with claim 1, further comprising:

one or more edge interlock are disposed proximate to edge of the exterior surface inlay and configured to interconnect the exterior surface inlay with plurality of other furniture inlay personal protection shields forming a barricade in which more than one of the user can assume protected positions by positioning the barricade between the user and bodily harm threat.

11. The furniture inlay personal protection shield in accordance with claim 1, an ammunition impact sensor is located proximate to the bullet-resistant inner liner, a control system comprises a microcontroller, a memory, a communication interface, and the ammunition impact sensor, the memory, the communication interface, and the ammunition impact sensor are operationally related to the microcontroller, the memory is encoded with instructions that when executed by the microcontroller perform the following steps:

determining, by way of the ammunition impact sensor, at least one of a bullet impact on the bullet-resistant inner liner; and communicating, by way of the communication interface, a bullet alert notification to a remote data processing resource.

12. A method of using a furniture inlay personal protection shield that is removable from furniture to provide personal protection, in an emergency, from bodily harm threats, the method comprising the steps of:

receiving a remote lock signal from a remote data processing resource, by way of a communication interface, and locking a quick-release lever, by way of an electronic lock, to prevent use of the quick-release lever to release an inlay interlock; or receiving a remote unlock signal from the remote data processing resource, by way of the communication interface, and unlocking the quick-release lever, by way of the electronic lock, for use prior to using the quick-release lever to release the inlay interlock, the quick-release lever further comprising the electronic lock, a control system comprises a microcontroller, the communication interface, and the electronic lock, the communication interface, and the electronic lock are operationally related to the microcontroller;

using the furniture inlay personal protection shield by:

activating the quick-release lever, the quick-release lever is accessible to a user while the furniture inlay personal protection shield is secured in furniture predefined opening;

removing the furniture inlay personal protection shield from furniture, by way of the user operating the quick-release lever to release an inlay interlock that allows the user to remove the furniture inlay personal protection shield from furniture, the furniture inlay personal protection shield comprising an exterior surface inlay that is sized and fabricated to fit predefined opening in furniture surface, a bullet-resistant inner liner is affixed to interior side of the exterior surface inlay, at least one handle is affixed proximate to the bullet-resistant inner liner;

orientating the furniture inlay personal protection shield, by way of the handle, in a manner that securely positions the bullet-resistant inner liner between the user and bodily harm threat; and viewing, by way of the user, bodily harm threat through a one-way viewable bullet-resistant material that is integrated into and away from perimeter of the exterior surface inlay, the one-way viewable bullet-resistant material is see-through in only one direction providing viewport therethrough such that the user positioned behind the furniture inlay personal protection shield can see bodily harm threat but bodily harm threat cannot see the user.

13. The method in accordance with claim 12, further comprising the step of:

unfolding an apron that is bullet-resistant forming a blanket suitable for covering one or more of the user, the bullet-resistant inner liner further comprises the apron.

14. The method in accordance with claim 12, further comprising the steps of:

determining, by way of the ammunition impact sensor, at least one of a bullet impacted on the bullet-resistant inner liner, an ammunition impact sensor is proximate to the bullet-resistant inner liner, a control system comprises a microcontroller, a memory, a communication interface, and the ammunition impact sensor, the memory, the communication interface, and the ammunition impact sensor are operationally related to the microcontroller; and communicating, by way of the communication interface, a bullet alert notification to a remote data processing resource.

15. The method in accordance with claim 12, further comprising the step of:

retrieving for use by the user, from a self-defense compartment that is secured proximate the bullet-resistant inner liner, one or more of the following: a lethal weapon, a non-lethal weapon, a self-defense spray, a digital communication device, a plurality of medical supplies, or a plurality of food or water supplies.

16. The method in accordance with claim 12, further comprising the step of:

interconnecting plurality of furniture inlay personal protection shields forming a barricade in which more than one of the user can assume protected positions, one or more edge interlock are disposed proximate edge of the exterior surface inlay and configured to interconnect the exterior surface inlay with plurality of other furniture inlay personal protection shields forming a barricade in which more than one of the user can assume protected positions by positioning the barricade between the user and bodily harm threat.

17. A furniture inlay personal protection shield is removable from furniture to provide personal protection, in an emergency, from bodily harm threats, the furniture inlay personal protection shield comprising:

an exterior surface inlay that is sized and fabricated to fit into predefined opening in furniture surface;

a bullet-resistant inner liner is affixed to interior surface of the exterior surface inlay;

at least one handle is affixed proximate the bullet-resistant inner liner where a user can, by way of the handle, securely position the bullet-resistant inner liner between the user and bodily harm threat;

a camera is mounted proximate to the exterior surface inlay;

an ammunition impact sensor is located proximate to the bullet-resistant inner liner, a control system comprises a microcontroller, a memory, a communication interface, and the ammunition impact sensor, the memory, the communication interface, and the ammunition impact sensor are operationally related to the microcontroller, the memory is encoded with instructions that when executed by the microcontroller perform the following steps of:

detecting that the furniture inlay personal protection shield has been released from furniture;

initiating, based on the step of detecting, operation of the camera, the camera is configured to perform at least one of the following: record audio/video or picture images, view audio/video or picture images received or recorded on a display, transmit audio/video or picture images to remote locations, or communicate audio/video or picture images between other cameras;

determining, by way of the ammunition impact sensor, at least one of a bullet impacted on the bullet-resistant inner liner; and communicating, by way of the communication interface, a bullet alert notification to a remote data processing resource.

18. The furniture inlay personal protection shield in accordance with claim 17, further comprising:

a one-way viewable bullet-resistant material is integrated into and away from perimeter of the exterior surface inlay, the one-way viewable bullet-resistant material is see-through in only one direction providing viewport therethrough such that the user positioned behind the furniture inlay personal protection shield can see bodily harm threat but bodily harm threat cannot see the user.

* * * * *